US010227735B2

(12) United States Patent
Hills et al.

(10) Patent No.: US 10,227,735 B2
(45) **Date of Patent: *Mar. 12, 2019**

(54) PAVEMENT JOINTS AND METHODS FOR TREATING THE SAME

(71) Applicant: Advanced Concrete Technologies LLC, Orem, UT (US)

(72) Inventors: Dal N. Hills, Midway, UT (US); Jeff Koebrick, St. Augustine, FL (US); Kason Hills, Midway, UT (US)

(73) Assignee: Advanced Concrete Technologies LLC, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/729,556

(22) Filed: Oct. 10, 2017

(65) Prior Publication Data

US 2018/0030668 A1 Feb. 1, 2018

Related U.S. Application Data

(63) Continuation of application No. 14/597,192, filed on Jan. 14, 2015, now Pat. No. 9,783,937.

(Continued)

(51) Int. Cl.

| | |
|---|---|
| ***E01C 11/10*** | (2006.01) |
| ***E01C 11/06*** | (2006.01) |
| ***E01D 19/06*** | (2006.01) |

(52) U.S. Cl.

CPC ..... *E01C 11/103* (2013.01); *E01C 11/06* (2013.01); *E01D 19/06* (2013.01)

(58) Field of Classification Search

CPC ..... H02G 9/02; E01C 11/103; E01C 11/06; E01D 19/06

See application file for complete search history.

(56) References Cited

U.S. PATENT DOCUMENTS 1,800,193 A * 4/1931 Fischer ..... E01C 11/126 106/DIG. 3
1,807,905 A * 6/1931 Fischer ..... C08L 95/00 106/164.51

(Continued)

FOREIGN PATENT DOCUMENTS

WO 2013016587 1/2013

OTHER PUBLICATIONS

United States Patent and Trademark Office, Acting As the International Searching Authority, "International Search Report & Written Opinion," dated Dec. 7, 2012 in international patent application No. PCT/US2012/048416.

*Primary Examiner* — Abigail A Risic
(74) *Attorney, Agent, or Firm* — Durham Jones & Pinegar, P.C., Intellectual Property Law Group

(57) ABSTRACT

A technique for protecting joints in pavement structures includes applying a hardener/densifier to one or more surfaces that define a joint in a pavement structure and, optionally, to portions of one or more surfaces that are located adjacent to the joint. One or more other compounds, such as hydrophobic materials, water resistant materials, anti scaling compounds, anti wear compounds, multi functional blended compositions and the like, may also be applied to the surfaces that define a joint and/or to portions of one or more surfaces that are adjacent to the joint. A seal may also be formed in a joint in a pavement structure. Joints that have been protected in accordance with teachings of this disclosure are also disclosed.

19 Claims, 4 Drawing Sheets

Related U.S. Application Data

(60) Provisional application No. 61/926,950, filed on Jan. 14, 2014.

(56) References Cited

U.S. PATENT DOCUMENTS 1,838,036 A * 12/1931 Fischer ..... E01C 11/103 106/164.6
1,934,266 A * 11/1933 Hession ..... E04B 1/6801 404/64
2,053,562 A * 9/1936 Jorgensen ..... C09K 17/10 405/266
2,104,059 A * 1/1938 Snelling ..... E01C 11/103 404/34
2,290,613 A * 7/1942 Greenup ..... C08L 7/02 404/64
2,339,556 A * 1/1944 Greenup ..... E01C 11/103 404/64
2,591,625 A * 4/1952 Simonsson ..... E04C 5/017 264/135
3,151,416 A * 10/1964 Eakin ..... F17C 3/005 220/560.03
3,334,557 A * 8/1967 Fitzgibbon ..... E01C 11/103 264/46.5
3,366,502 A * 1/1968 Lombardo ..... C04B 28/02 106/12
3,390,496 A * 7/1968 Weiner ..... B28B 19/0007 264/256
3,489,685 A * 1/1970 Kublicki ..... C04B 26/26 106/281.1
3,503,311 A * 3/1970 Gagle ..... E01C 11/10 404/74
3,523,493 A * 8/1970 Berry ..... C08L 17/00 404/47
3,555,763 A * 1/1971 Bloxom ..... E04B 1/94 264/338
3,587,964 A * 6/1971 Elgin, III ..... E01B 2/003 14/73
3,799,798 A * 3/1974 Elmer et al. ..... C04B 41/4838 427/379
3,806,481 A * 4/1974 Blatt ..... C08L 21/00 404/67
3,810,707 A * 5/1974 Tungseth ..... E01C 11/10 404/67
3,976,497 A * 8/1976 Clark ..... C09D 183/04 106/287.16
4,127,350 A * 11/1978 Weber ..... E01C 11/106 404/65
4,144,074 A * 3/1979 Itoh ..... C04B 28/24 106/1.17
4,572,702 A * 2/1986 Bone ..... E01D 19/06 14/73.5
4,761,312 A * 8/1988 Koshi ..... B05D 5/02 427/387
5,814,693 A * 9/1998 Priest ..... C08K 5/544 428/447
5,868,894 A * 2/1999 Frenkel ..... C04B 7/22 156/281
5,998,525 A 12/1999 Wang et al.
6,155,907 A 12/2000 Jones
6,454,632 B1 * 9/2002 Jones ..... C04B 41/5089 264/31
6,491,472 B1 * 12/2002 Lu ..... E01C 11/103 404/74
7,737,195 B2 6/2010 Gimvang
8,627,627 B2 * 1/2014 Findlay ..... E01C 11/126 52/396.03
8,852,334 B1 * 10/2014 Hills ..... C04B 28/02 106/600
2003/0223814 A1 * 12/2003 Peitz ..... E01C 11/103 404/75
2004/0033315 A1 * 2/2004 Trabesinger ..... C04B 41/009 427/386
2004/0159073 A1 * 8/2004 Palermo ..... C04B 41/533 52/745.19
2005/0141961 A1 * 6/2005 Steffes ..... E01C 23/025 404/75
2006/0063689 A1 3/2006 Netherton
2008/0008525 A1 * 1/2008 Dawson ..... E01C 11/103 404/69
2008/0194735 A1 8/2008 Verdugo-Perez et al.
2008/0261024 A1 * 10/2008 Xenopoulos ..... C04B 26/32 428/331
2011/0190420 A1 * 8/2011 Nagelsdiek ..... C04B 26/14 523/428
2012/0015199 A1 * 1/2012 Turner ..... C04B 28/02 428/447
2014/0099874 A1 * 4/2014 Emmons ..... C04B 41/009 454/305

* cited by examiner

PAVEMENT JOINTS AND METHODS FOR TREATING THE SAME

CROSS-REFERENCE TO RELATED APPLICATION

This application is a continuation of U.S. patent application Ser. No. 14/597,192, filed on Jan. 14, 2015 and titled PAVEMENT JOINTS AND METHODS FOR TREATING THE SAME ("the '192 Application"), issued as U.S. Pat. No. 9,783,937 on Oct. 10, 2017. The '192 Application included a claim for the benefit of priority under 35 U.S.C. § 119(e) to the Jan. 14, 2014 filing date of U.S. Provisional Patent Application No. 61/926,950, titled SEALED PAVEMENT JOINTS ("the '950 Provisional Application"). The entire disclosures of the '950 Provisional Application and the '192 Application are incorporated herein by this reference.

TECHNICAL FIELD

This disclosure relates generally to joints in pavement and to techniques and methods for protecting and/or prolonging the useful lives of joints in pavement. More specifically, this disclosure relates to techniques in which the surfaces of pavement (e.g., concrete pavement, etc.) that define joints in the pavement, as well as pavement surfaces that are adjacent to the joint may be protected by hardening and/or densification. Protected joints may be open, or "unsealed," or they may be closed, or "sealed." This disclosure also relates to joints and adjacent pavement surfaces that have been protected by hardening and/or densification.

RELATED ART

Joints in pavement, including the joints in highways, joints that are present at the pavement of bridges, joints in parking decks and joints in other pavement structures, and the pavement surfaces within which the joints are formed are subject to deterioration (e.g., corrosion or other deterioration within the joint, surface deterioration, etc.) in a variety of environments, including environments that experience cold winters and environments that experience freeze-thaw cycles. Deterioration of joints in pavement and deterioration of pavement surfaces may be caused by a variety of factors, including, but not limited to, impingement of moisture, freeze-thaw cycles and chemicals that are used to prevent the formation of ice and/or to deice pavement, wear and/or abrasion. The composition of the pavement or adjacent structures may also lead to premature deterioration, particularly where softer aggregates are used (e.g., soft limestone, medium limestone, etc.) or the mix (e.g., concrete mix, etc.) is not particularly durable. The quality of the finish, the finishing technique and/or the manner in which a pavement material or the material of an adjacent structure is cured may also lead to early distress and/or deterioration.

Some attempts have been made to prevent deterioration, such as corrosion, in joints by applying sealants (e.g., silanes, siloxanes, etc.) to the surfaces that define a joint and/or by sealing the openings of joints (e.g., by forming or otherwise introducing a silicone seal, a hot-melt seal, a preformed seal, etc., into the joint; etc.). When a seal in a joint in pavement is new and the seal has properly adhered to the surfaces of the pavement that define the joint, the seal may prevent moisture from getting into the joint and protect the joint from other types of weathering. By preventing moisture intrusion, seals may also prevent sub-grade deterioration of a pavement structure. The lifespans of joint seals are, however, limited. As a joint seal fails, it may separate from one or more surfaces that define the joint. With the joint seal separated from one or more of these surfaces, they may be directly exposed to the elements and/or to chemicals that may corrode or otherwise deteriorate material at the surfaces. Such corrosion or deterioration may allow for moisture intrusion, as well as the ability of the moisture to wick through the surface and into the structure, which may cause surface deterioration, such as spalling, edge chipping or edge cracking.

Even during their useful lives, conventional joint seals do not prevent moisture or chemicals that collect on a pavement surface from creeping into the joint through the concrete or other materials that define the pavement in which the joint is defined. Thus, the protection provided by conventional joint seals is limited.

Many times, joints are left unsealed. In an unsealed, or open, joint, the surfaces that define the joint may be subjected to a variety of factors (e.g., environmental factors, moisture, loading, etc.) that lead to deterioration. The potential for joint deterioration may be even further enhanced in newly constructed pavement structures, in which joints may be formed as narrow saw cuts after a curing compound has been applied to the surface, but still during early stages of hydration. When joints are formed after a curing compound has been applied to the surface, the curing compound is usually not present on the newly defined surfaces of the joint. Consequently, water may evaporate from the newly defined surfaces of the joint differently (e.g., more quickly) than it evaporates from the cured surfaces, which may cause salt migration through the pavement structure and, thus, efflorescence, as well as increased porosity of the uncured surfaces of the joint and dusting. In addition, saw cutting may distress the pavement structure, potentially resulting in micro-fissures and other weaknesses.

SUMMARY

In one aspect, this disclosure relates to techniques and methods for protecting joints in pavement from deterioration (e.g., from spalling, scaling, other types of corrosion or deterioration, etc.). Optionally, a technique or method according to this disclosure may also include protecting pavement surfaces that are adjacent to joints in pavement.

As used herein, the term "joint" may refer to the opposed, or facing, surfaces of two or more adjacent structures, such as sections of pavement (e.g., a roadway, a runway, a bike path, a sidewalk, etc.), sections of a bridge (e.g., paved sections; vertical elements of the bridge, such as curbs, walls, columns and/or pillars; etc.), sections of a parking structure (e.g., a parking deck, vertical elements of the parking structure, etc.), sections of other pavement structures and sections from any combination of the above-identified pavement structures. Joints may also comprise control joints (e.g., longitudinal control joints, transverse control joints, etc.) that have been defined in a structure. In some embodiments, the surfaces that define a joint may be vertically oriented or substantially vertically oriented. In addition to the opposed surfaces, a joint in pavement includes the gap between the opposed surfaces.

The phrase "pavement surfaces" refers to the firm, level surfaces of a pavement structure that are made to bear a load (e.g., from a vehicle, an individual, etc.), or over which travel occurs. The pavement surfaces of a pavement structure are also referred to in the art as "horizontal surfaces," even though they may be oriented along an incline (e.g., a hill, as a ramp, etc.). In addition, for purposes of this disclosure, the phrase "pavement surfaces" may include more vertically oriented surfaces of a pavement structure, such as those defined by curbs, walls, columns, pillars or the like that may define part of a joint with a more horizontally oriented surface of the pavement structure. Pavement surfaces that are located adjacent to and near a joint in pavement may be referred to herein as "adjacent pavement surfaces."

A joint may be protected in conjunction with the construction of a new pavement structure, in conjunction with the formation of a joint in a pavement structure, or in conjunction with the repair and/or refurbishment of a joint. A joint of a new pavement structure or a newly formed joint may be protected within a certain time of the joint's formation (e.g., within a day, a week, a month, three months, six months, etc.) to preserve the joint before the joint or the pavement structure of which the joint is a part starts to erode. Joints that do not show signs of deterioration or distress may also be treated to enhance their lives, or for preservation purposes. Repair and/or refurbishment of a joint may, without limitation, include partial depth repairs or full depth repairs. Joints that have experienced scaling, spalling or other signs of deterioration may be repaired and/or refurbished, and then protected. Protection of such a repaired and/or refurbished joint may prolong the life of the joint and its adjacent pavement surfaces (e.g., for a year, two years, etc.). A joint may also be protected in conjunction with smoothing one or both pavement surfaces adjacent to the joint (e.g., by diamond grinding; etc.), which open surface pores and, without some protection, might subject the joint and adjacent areas of the pavement structure to premature deterioration.

Protection of a joint may include application of a hardener/densifier to surfaces that define the joint (e.g., side edge surfaces of adjacent structural sections, such as sections of pavement. Optionally, protection of a joint may include application of the hardener/densifier to pavement surfaces adjacent to the joint. Protection of the adjacent pavement surfaces may prevent the elements, moisture, potentially corrosive chemicals and other factors that may cause corrosion or deterioration from migrating through sections of a pavement structure into a joint. In some embodiments, a technique or a method for protecting a joint in pavement may also include application of one or more additional compounds to the joint and/or to pavement surfaces that are adjacent to the joint. The additional compound(s) may be applied before the hardener/densifier, with the hardener/densifier (e.g., separately, but concurrently; as a mixture; etc.) or after the hardener/densifier. As a non-limiting example, a hydrophobic material or a water-repellant material, such as a so-called "anti-scaling compound," and/or a sealant may be applied to the surfaces that define a joint and/or to pavement surfaces that are adjacent to the joint. As another example, an anti-wear compound may be applied to surfaces that define the joint and/or to portions of one or more pavement surfaces next to the joint. Optionally, a technique or method for protecting a joint in pavement may also include forming a seal in the joint or introducing a seal into the joint, although the use of a seal in a joint is by no means necessary.

The disclosed techniques and methods may be used to protect joints in new pavement, new joints in existing pavement, or existing joints in existing pavement.

In embodiments where an existing joint in existing pavement is to be sealed, the joint may first be cleaned. Cleaning of the joint may include removing an existing (e.g., old, damaged, etc.) seal from the joint. In addition, dirt and/or debris may be removed from the joint. Corrosion or deterioration may also be removed from the joint. The act of cleaning may comprise washing the joint with a pressurized cleaning agent (e.g., air, water, a chemical cleaning agent, an etchant, an acid, a hardener/densifier under pressure, etc.). Dust and debris may also be vacuumed from a joint and adjacent pavement surfaces. In some embodiments, the surfaces that define a joint may be mechanically abraded (e.g., sandblasted, shot blasted, abraded with a wire brush, abraded or cut with a saw blade, etc.) or otherwise treated) to clean, or even refurbish, them. Dust may be at least partially removed from the surfaces that define the joint, and from pavements surfaces that are adjacent to the joint.

A new joint may be formed in existing pavement by cutting (e.g., saw cutting, etc.) into the pavement to define the joint, including its opposed surfaces and the gap therebetween. When the technique for forming the joint creates dust, formation of the joint may be follows by removal of at least some dust from the surfaces that define the joint, and from the pavement surfaces that are adjacent to the joint.

When the surfaces that define the joint are clean, the hardener/densifier may be applied to the joint and, optionally, to pavement surfaces that are located adjacent to the joint. One or more additional compounds may also be applied to the surfaces that define the joint and/or to pavement surfaces that are located adjacent to the joint. In some embodiments, the joint may be sealed.

Other aspects, as well as features and advantages of various aspects, of the disclosed subject matter will become apparent to those of ordinary skill in the art through consideration of the ensuing description and the appended claims.

DETAILED DESCRIPTION

Figure 1:
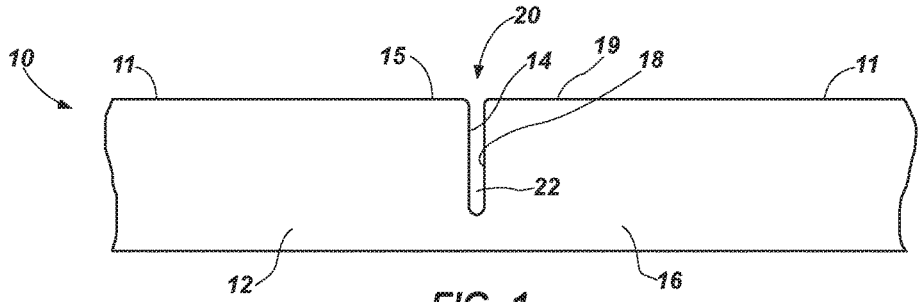
FIG. 1 illustrates a joint in pavement.

With reference to FIG. 1, a pavement structure 10 with a pavement surface 11 is depicted. The pavement structure 10 includes at least two adjacent sections 12 and 16 with a joint 20 therebetween. The sections 12 and 16 of the pavement structure 10 may, as shown in FIG. 1, define parts of the pavement surface 11. Alternatively, one of the sections 12, 16 may comprise another type of structure (e.g., a curb, a wall, a column, a pillar, etc.) adjacent to a second of pavement.

The joint 20, which extends downward into the pavement surface 11 of the pavement structure 10, may be defined by opposed surfaces 14 and 18 of the sections 12 and 16 of the pavement structure 10. As illustrated, the opposed surfaces 14 and 18 that define the joint 20 may be vertically oriented or substantially vertically oriented. In addition to the opposed surfaces 14 and 18, the joint 20 may include a gap 22 located between the opposed surfaces 14 and 18. Although the joint 20 is illustrated as extending only partially into the pavement structure 10, joints that extend completely through pavement structures are also within the scope of this disclosure.

Portions of the pavement surface 11 that are located adjacent to the joint 20, on opposite sides of the joint 20, are identified in FIG. 1 by reference characters 15 and 19, and correspond to section 12 and section 16 of the pavement structure 10, respectively. Although the portions 15 and 19 of the pavement surface 11 are both illustrated as comprising horizontal surfaces, one or both of the portions 15 and 19 may comprise a more vertically oriented surface, such as a surface of a curb, a wall, a column, a pillar or the like.

In some embodiments, the pavement structure 10 may comprise a new pavement structure 10. The joint 20 may have been defined as the pavement structure 10 was constructed (e.g., using forms, spacers, etc.). Alternatively, the joint 20 may have been defined after the pavement structure 10 was constructed (e.g., with a saw, etc.).

In other embodiments, the pavement structure 10 may comprise an existing pavement structure 10, with the joint 20 comprising an existing joint in the pavement structure 10. The joint 20 may be clean, with dirt, debris and any other items (e.g., old seals, spacers, etc.) having been removed from its gap 22 and any sealants having been stripped from its opposed surfaces 14 and 18. Suitable processes for cleaning a joint 20 include, but are not limited to, use of one or more pressurized cleaning agents (e.g., air, water, a chemical cleaning agent, an etchant, an acid, a hardener/densifier under pressure, etc.) in combination and/or in sequence, vacuuming the joint, mechanical abrasion (e.g., sandblasting, shot blasting, abrading with a wire brush, abrading or cutting with a saw blade, etc.) or a combination of one or more pressurized cleaning agents, vacuuming and mechanical abrasion.

In still other embodiments, the pavement structure 10 may comprise an existing pavement structure 10, and the joint 20 may be newly formed (e.g., saw cut, etc.) into the pavement surface 11 of the pavement structure 10.

One or more joints 20 in the pavement structure 10 may be protected by applying a compound that includes a hardener/densifier to the surfaces (e.g., the opposed surfaces 14 and 18 of the adjacent sections 12 and 16, respectively; etc.) that define the joint 20. In some embodiments, such a compound may also be applied to portions 15 and 19 of the pavement surface 11 that are located adjacent to the joint 20. In other embodiments, a compound that includes a hardener/densifier may be applied to the entire pavement surface 11.

A hardener/densifier may be introduced into a joint 20 (i.e., onto surfaces that define the joint, such as the opposed surfaces 14 and 18) and, optionally, onto portions 15 and 19 of the pavement surface 11 by any suitable technique. Various embodiments of the manner in which a hardener/densifier may be introduced into a joint 20 include, but are not limited to, spraying the hardener/densifier into the joint 20 and, optionally, onto the portions 15 and 19 of the pavement surface 11 that are located adjacent to the joint 20; and pouring the hardener/densifier into the joint 20 and onto the adjacent portions 15 and 19 of the pavement surface 11.

The hardener/densifier will react with free calcium hydroxide (lime), a byproduct of cement hydration, which is present at the surfaces to which the hardener/densifier is applied. The result of the reaction between the hardener/densifier and the lime is calcium silicate hydrate (C-S-H) gel, which provides a durable paste that will increase the hardness and abrasion-resistance of the surfaces to which the hardener/densifier is applied, and reduce porosity of these surfaces.

The reaction between the hardener/densifier and the lime present at the opposed surfaces 14 and 18 of the joint 20 and at the portions 15 and 19 of the pavement surface 11 that are adjacent to the joint 20 may also reduce the likelihood that deicing chemicals, such as calcium chloride and magnesium chloride, will cause deterioration of these surfaces. In particular, the hardener/densifier will reduce the amount of lime available at these surfaces, which lime could otherwise react with the common deicing chemicals to form compounds, such as calcium oxychloride, that deteriorate materials from which pavement is formed (e.g., concrete, etc.).

Suitable hardeners and/or densifiers include compositions comprising alkali metal silicates, such as lithium polysilicates (e.g., the hardener/densifier available from Convergent Concrete Technologies, LLC of Orem, Utah as PENTRA-SIL® (HD) hardener/densifier; the densifier available from Dayton Superior Corporation of Miamisburg, Ohio as PENTRA-HARD® densifier; etc.), potassium silicates and/or sodium silicates, as well as low pH compositions (i.e., pH of 10 or less) comprising colloidal silica (e.g., the hardener/densifier available from Global Polishing Systems, LLC of Henderson, Nev. as CDH-100; etc.). Various combinations of hardeners and/or densifiers may also be used.

Figure 2:
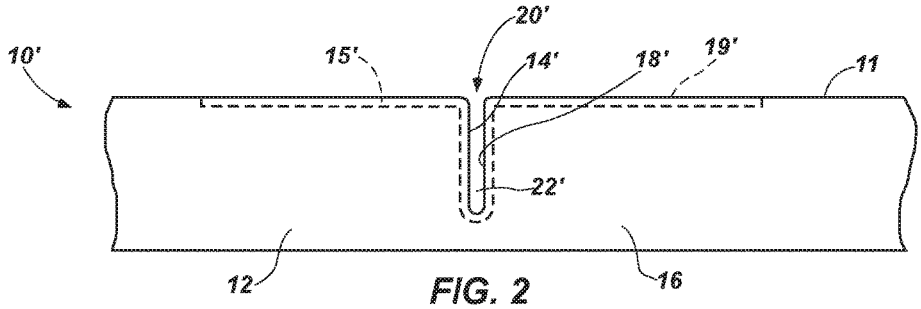
FIG. 2 shows a joint in pavement with surfaces that have been hardened and/or densified.

FIG. 2 illustrates an embodiment of a joint 20' with opposed surfaces 14' and 18' that have been hardened and/or densified. In addition, portions 15' and 19' of the pavement surface 11 that are located adjacent to the joint 20' may also be hardened and/or densified. Such a hardened and/or densified portion 15', 19' may comprise a strip located along the joint 20'. Such a strip may have a width (i.e., extend from the joint 20') about six inches, 8 to 12 inches, about 12 inches, about 18 inches or about 24 inches. In some embodiments, an entire pavement surface 11 may be hardened and/or densified. The joint 20' may, for purposes of this disclosure, be considered to comprise a protected joint even though the joint 20' includes an open gap 22'.

In embodiments where another, additional compound is, in addition to the hardener/densifier, applied to the surfaces that define a joint 20 (e.g., opposed surfaces 14 and 18, etc.) and/or to the portions 15 and 19 of the pavement surface 11 that are located adjacent to the joint 20, the hardener/densifier enhance adhesion and/or bonding of the additional compound to these surfaces. In particular, the hardener/densifier may reduce one or more of porosity, dusting, microcompressibles (i.e., dust particles, etc., that are impacted into pores and compressed onto surfaces during mechanical processing, such as saw cutting, shot blasting or the like), other contamination, efflorescence and alkalinity of the surfaces that define and/or are adjacent to the joint 20.

Various non-limiting examples of additional compounds include anti-scaling compounds (e.g., metal siliconates, such as potassium methyl siliconate, sodium methyl siliconate, etc.) and other water-repellant materials, sealants (e.g., silanes, siloxanes, combinations thereof, etc.) and other coatings. In some embodiments, two or more additional compounds may be used with a hardener/densifier. These additional compounds may be separate from the hardener/densifier or they may be combined with the hardener/densifier.

Some non-limiting examples of chemical compositions that include a hardener/densifier and an additional compound (e.g., an anti-scaling compound, etc.) are the chemical compositions available from Convergent Concrete Technologies, LLC, of Orem, Utah under the trademarks PENTRA SHIELD® and TRANSIL®. U.S. Pat. No. 7,737,195 of Gimvang discloses another example of a composition that includes a hardener/densifier, along with additional compounds.

Compositions that include a hardener/densifier and an emulsion (e.g., a mechanical emulsion, etc.) of a solvent-based silane may also be used to protect joints. Such a mixture may include a solvent-based silane having about 40% or more solids, by weight, dispersed throughout (e.g., mechanically, by use of an emulsion blade; etc.) a hardener/densifier (e.g., an aqueous hardener/densifier, etc.), and may include a variety of different proportions of the hardener/densifier and the solvent-based silane. Alternatively, such a mixture may be made by dispersing a so-called "neat" silane, which may include 98% or more solids, by weight, throughout a hardener/densifier. Such a composition may be pre-made, stored (e.g., for up to six months or more) and provided on-site as an all-in-one product. Alternatively the hardener/densifier and the solvent-based silane or neat silane may be provided separately from one another, and then mixed on-site before being applied to the joint 20 and, optionally, to other parts of a pavement structure 10.

In other embodiments, the additional compound may be separate from the hardener/densifier. As an example, a sealant, such as a silane (e.g., a water-based silane, a solvent-based silane, etc.) or a siloxane, may be used in conjunction with a separate hardener/densifier. As other examples, a corrosion-resistant coating and/or an abrasion-resistant coating (e.g., that disclosed by U.S. Patent Application Publication 2009/0110834 of Gimvang, etc.) may be used in conjunction with a separate hardener/densifier.

With variations in the types of hardener(s) and/or densifier(s) and additional compounds that are used to protect a joint 20, 20' (FIGS. 1 and 2, respectively) in a pavement structure 10, the additional compound may be applied to the surfaces of the joint 20, 20' (e.g., opposed surfaces 14, 14' and 18, 18', etc.—FIGS. 1 and 2, respectively) and/or to the portions 15, 15' and 19, 19' (FIGS. 1 and 2, respectively) of the pavement surface 11 that are located adjacent to the joint 20, 20' separately from a hardener/densifier (e.g., after applying the hardener/densifier, at the same time as the hardener/densifier is applied, or before applying the hardener/densifier) or as part of the same compound as the hardener/densifier.

In a specific embodiment, a hardener/densifier may be applied to the surfaces that define a joint 20, 20' (FIGS. 1 and 2, respectively) (e.g., opposed surfaces 14, 14' and 18, 18', etc.—FIGS. 1 and 2, respectively) and/or to the portions 15, 15' and 19, 19' (FIGS. 1 and 2, respectively) of the pavement surface 11 that are located adjacent to the joint 20, 20', and then one or more additional compounds may be applied to the surfaces that define the joint 20, 20' and/or to portions 15, 15' and 19, 19' of the pavement surface 11 adjacent to the joint 20, 20'. As a hardener/densifier may become hydrophobic once it dries and reacts with the surface(s) to which it is applied, the additional compound(s) may be applied to each surface to which the hardener/densifier was applied before the hardener/densifier dries, or while the hardener/densifier is still wet (e.g., within 24 hours of when the hardener/densifier was applied, etc.).

In another embodiment, an additional compound (e.g., an anti-scaling compound; a sealant; a wear-resistant, or anti-wear compound; etc.) may be applied to the surfaces that define a joint 20, 20' (FIGS. 1 and 2, respectively) (e.g., opposed surfaces 14, 14' and 18, 18', etc.—FIGS. 1 and 2, respectively) and/or to portions 15, 15' and 19, 19' (FIGS. 1 and 2, respectively) of the pavement surface 11 adjacent to the joint 20, 20' before the hardener/densifier is applied to those locations. When the hardener/densifier and the additional compound are applied in this manner, the hardener/densifier may be applied before the additional compound dries, or while the additional compound is still wet.

Figure 3:
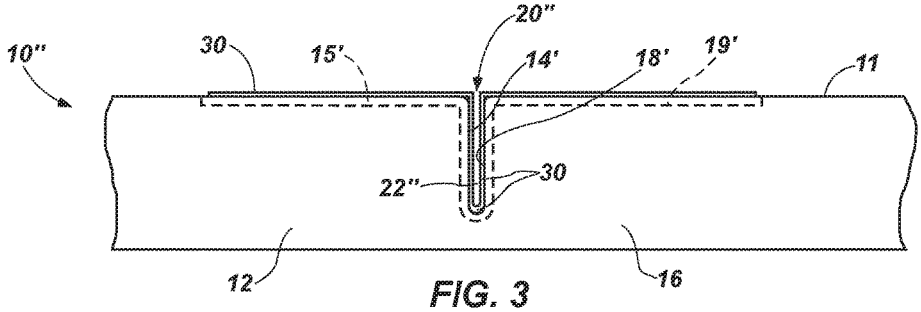
FIG. 3 shows a joint in pavement with surfaces to which an additional compound (e.g., a water-repellant material, a sealant, etc.) has been applied.

An embodiment of a joint 20" that includes a coating 30 formed by an additional compound on hardened and/or densified surfaces of the joint 20" (e.g., opposed surfaces 14' and 18', etc.) and/or adjacent to the joint 20" (e.g., portions 15' and 19' of the pavement surface 11, etc., that have been hardened and/or densified) is illustrated by FIG. 3. In some instances, and for purposes of this disclosure, such a joint 20" may be considered to be protected, even though the joint 20" still includes an open gap 22".

Figure 4:
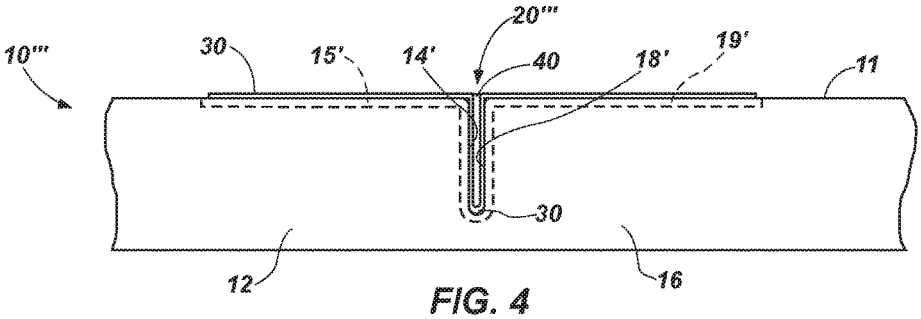
FIG. 4 depicts a joint with surfaces that have been hardened and/or densified, optionally sealed, and with a gap that is at least partially filled with a seal.

Turning now to FIG. 4, a seal 40 may be formed in or otherwise introduced into a joint 20', 20" (FIGS. 2 and 3, respectively). The formation of a seal 40 may follow the application of additive compound, such as a water-repellant material, an anti-scaling compound or a sealant, onto surfaces that define the joint 20', 20". Formation of the seal 40 may include introducing a suitable sealing material into the joint 20', 20". DOW CORNING® 888 silicone joint sealant and DOW CORNING® 890 silicone joint sealant, both of which are available from Dow Corning Corporation of Midland, Mich., are two non-limiting examples of sealing material that are suitable for use in the joints 20', 20" of pavement structures 10', 10" (FIGS. 2 and 3, respectively). Alternatively, a hot-melt composition (e.g., a hot-melt adhesive, etc.) may be introduced into a joint 20', 20" to form a seal 40 in a gap 22', 22" of the joint 20', 20". As another option, a preformed seal 40 may be introduced into the gap 22', 22" of the joint 20', 20".

After a joint 20''' has been sealed, a hardener/densifier may, in some embodiments, be applied over the joint 20''', the seal 40 in the joint 20''' and portions 15' and 19' of the pavement surfaces 11 that are located adjacent to the joint 20'''.

With returned reference to FIG. 1, a specific embodiment of a process for protecting a joint 20, 20' in a pavement structure 10, 10' is disclosed. First, a hardener/densifier is applied to the opposed surfaces 14 and 18 that define a joint 20 in the pavement structure 10, as well as to portions 15 and 19 of the pavement surface 11 that abut top corners of the joint 20. Once the hardener/densifier (which may be combined with an anti-scaling compound) has penetrated into the surfaces to which it has been applied, but before the hardener/densifier has had the opportunity to fully react with the material (e.g., concrete, etc.) of the pavement structure 10 (i.e., while the affected portions of the pavement structure 10 are still saturated or at least wetted with the hardener/densifier), a hydrophobic coating may be applied to the opposed surfaces 14 and 18 that define the joint 20. Alternatively, or in addition, the hydrophobic coating may be applied to portions 15 and 19 of the pavement surface 11 that are located adjacent to the joint 20'. A few non-limiting examples of materials that are suitable for forming hydrophobic coatings at or adjacent to a joint 20 in a pavement structure 10 include, without limitation, aqueous silane solutions (which may be introduced into the joint 20), organic solvent-based silane solutions (which may be applied to portions 15 and 19 of the pavement surface 11 that are located adjacent to the joint 20 without substantially being introduced into the joint 20 (e.g., incidental spraying, etc., are acceptable)), silicone emulsions, and siloxanes.

Once the hydrophobic coating has been applied to surfaces of the pavement structure 10, a seal 40 may be formed in the joint 20''', as illustrated by FIG. 4. Formation of the seal 40 may include introducing a suitable sealant into the joint 20'''.

After the joint 20''' has been sealed, a hardener/densifier and/or an anti-wear agent may be applied over the joint 20''', the seal 40 in the joint 20''' and portions 15' and 19' of the pavement surfaces 11 that are located adjacent to the joint 20'''.

EXAMPLES

TABLES 1 and 2, which follow, provide some specific, but non-limiting examples of the manner in which a joint in pavement may be treated.

TABLE 1

| Designation | Joint # | Planned Pretreatment | Seal | Actual Pretreatment | Comments |
|---|---|---|---|---|---|
| C | 96 | NOTHING | EXISTING | | |
| D1 | 98 | 791 Anti-Scale | Silicone 888 | 791 Anti-Scale | Treated 12" on either side of joint & Inside Joint |
| T1 | 99 | TK Silane | Silicone 888 | | |
| D2 | 100 | Dual system solvent based | Silicone 888 | Dual System $H_2O$ Based | 790 (WB)-8" to 12" on either side of joint, not in the joint 791-12" on either side and inside joint |
| T2 | 102 | TK Siloxane | Silicone 888 | | |
| C | 103 | NOTHING | EXISTING | | |
| D1 | 105 | Treated Dual System $H_2O$ based | Silicone 888 | Dual System Solvent Based | 790-6" on either side of and inside joint 791-12" on either side of joint and inside joint |
| T1 | 106 | TK Silane | Silicone 888 | | |
| D2 | 108 | 791 Anti-Scale | Silicone 888 | 791 Anti-Scale | Treated 12" on either side of joint and inside joint |
| T2 | 109 | TK Siloxane | Silicone 888 | | |
| C | 113 | NOTHING | EXISTING | | |
| D1 | 114 | Dual system solvent based | Silicone 888 | Dual System $H_2O$ Based | 790 (WB)-8" to 12" on either side of joint, not in the joint 791-12" on either side and inside joint |
| T1 | 116 | TK Silane | Silicone 888 | | |
| D2 | 117 | Treated Dual System $H_2O$ based | Silicone 888 | Dual System Solvent Based | 790-6" on either side of and inside joint 791-12" on either side of joint and inside joint |

TABLE 2

| Designation | Joint # | Planned Pretreatment | Seal | Actual Pretreatment | Comments |
|---|---|---|---|---|---|
| C | 131 | NOTHING | EXISTING | | |
| D1 | 132 | 791 Anti-Scale | NO SEAL | 791 Anti-Scale | Treated 24" on either side of joint and inside joint |
| T1 | 133 | TK Silane | NO SEAL | | |
| D2 | 134 | Dual system solvent based | NO SEAL | Dual System $H_2O$ Based | Both treatments on 12" to 18" on either side of joint and inside joint |
| T2 | 136 | TK Siloxane | NO SEAL | | |
| C | 141 | NOTHING | EXISTING | | |
| D1 | 142 | Treated Dual System $H_2O$ based | NO SEAL | Dual System Solvent Based | 790-6" on either side ofjoint and inside joint 791-24" on either side of joint and inside joint |
| T1 | 143 | TK Silane | Silicone 888 | | |
| D2 | 144 | 791 Anti-Scale | Silicone 888 | 791 Anti-Scale | Treated 24" on either side of joint and inside joint. |
| T2 | 146 | TK Siloxane | Silicone 888 | | |
| C | 147 | NOTHING | EXISTING | | |
| D1 | 148 | NOTHING | Silicone 888 | | |
| T1 | 150 | NOTHING | Silicone 888 | | |
| D2 | 151 | NOTHING | Silicone 888 | | |
| T2 | 152 | NOTHING | Silicone 888 | | |
| C | 154 | NOTHING | EXISTING | | |
| D1 | 155 | Dual system solvent based | Silicone 888 | Dual System $H_2O$ Based | 790 (WB)-8" to 12" on either side of joint, not in the joint 791-12" on either side of joint and inside joint |

TABLE 2-continued

| Designation | Joint # | Planned Pretreatment | Seal | Actual Pretreatment | Comments |
|---|---|---|---|---|---|
| T1 | 158 | TK | Silane | Silicone 888 | |
| D2 | 159 | Treated Dual System $H_2O$ based | Silicone 888 | Dual System Solvent Based | 790-6" on either side ofjoint and inside joint 791-24" on either side of joint and inside joint |
| T2 | 160 | TK Siloxane | Silicone 888 | | |

In TABLES 1 and 2, the designation "C" refers to a control, in which existing joints were left as-is. The designations "D1," "T1," "D2" and "T2" refer to different types of tests.

The columns labeled "Planned Pretreatment" and "Actual Pretreatment" list the types of pre-treatments that are being considered in actual testing, and include no pretreatment, pretreatment with an anti-scaling agent, pretreatment with a hydrophobic coating or pretreatment with both an anti-scaling agent and a hydrophobic coating. "791 Anti-Scale" refers to use of PENTRA SHIELD®, available from Convergent Concrete Technologies, LLC, of Orem, Utah, as an anti-scaling agent. TK Siloxane and TK Silane are different types of hydrophobic coatings. "Dual system solvent based" refers to use of both the 791 Anti-Scale and an organic solvent-based silane. "Dual system $H_2O$ based" refers to use of both the 791 Anti-Scale and a water-based silane. Application of each of these treatments was about 180 $ft^2$ to about 200 $ft^2$ per gallon of anti-scaling agent and/or hydrophobic coating.

The column identified by the heading "Seal" refers to the type of seal that was in place after pre-treatment, if any pre-treatment was performed. "Silicone 888" designates the use of DOW CORNING® 888 silicone sealant.

The last column, which is labeled "Comments," provides information on how the pre-treatments were applied. The designation "790" refers to an organic solvent-based silane coating, while the designation "790 (WB)" refers to a water-based silane coating.

In a similar test, various treatments were applied to white topping, as set forth in TABLE 3.

TABLE 3

| Designation | Joint # | Planned Pretreatment | Actual Pretreatment |
|---|---|---|---|
| D1 | 4220 | 791 Anti-Scale | 791 Anti-Scale |
| C | 4221 | NOTHING | |
| T1 | 4222 | TK Silane | |
| C | 4223 | NOTHING | |
| D2 | 4224 | Dual system solvent based | Treated Dual System $H_2O$ based |
| C | 4225 | NOTHING | |
| T2 | 4226 | TK Siloxane | |
| C | 4227 | NOTHING | |
| D1 | 4228 | Treated Dual System $H_2O$ based | Dual system solvent based |
| C | 4229 | NOTHING | |
| T1 | 4230 | TK Silane | |
| C | 4231 | NOTHING | |
| D2 | 4232 | 791 Anti-Scale | 791 Anti-Scale |
| C | 4233 | NOTHING | |
| T2 | 4234 | TK Siloxane | |
| C | 4235 | NOTHING | |
| D1 | 4236 | Dual system solvent based | Treated Dual System $H_2O$ based |
| C | 4237 | NOTHING | |
| T1 | 4238 | TK Silane | |
| C | 4239 | NOTHING | |
| D2 | 4240 | Treated Dual System $H_2O$ based | Dual system solvent based |
| C | 4241 | NOTHING | |
| T2 | 4242 | TK Siloxane | |

In addition to performing tests that will verify that sealing a joint in accordance with this disclosure will prevent weathering and/or corrosion or deterioration of a pavement joint and, thus, improve the useful life of a pavement joint, several tests were performed to demonstrate that silicone seals adhere better to joints that have been prepared in accordance with teachings of this disclosure than to joints that have not been pre-treated. The graphs and table that follow illustrate these phenomena. In the experiments that are depicted by the following graphs and table, the controls were not pre-treated. The designated pre-treatment was applied, by brushing, to joints with the following dimensions: ½" wide by ½" deep by 2" long joint (TA made with 3" by 1" by 1"). Anti-scale and anti-wear pre-treatments were applied at full strength. The pre-treated joints were allowed to dry for the period of time specified below before the sealant was applied to, or introduced into, the joint. The sealant was then permitted to cure for 14 days before testing. Testing included a movement test of +100/−50% for 10 cycles over 4 days.

Figure 5:
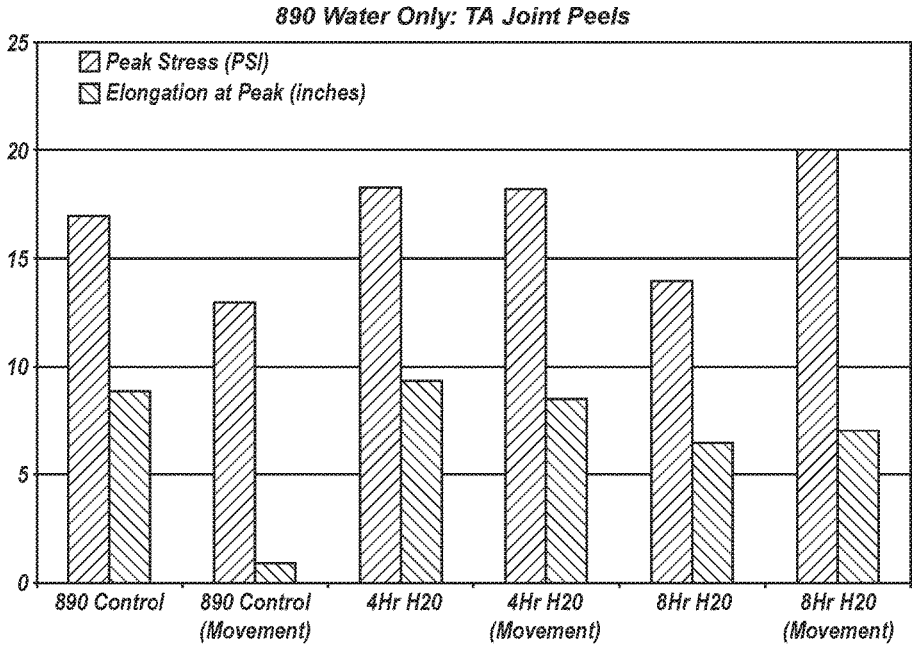
FIGS. 5-10 are graphs illustrating the effects of various joint protection treatments.

In the graph of FIG. 5, DOW CORNING® 890 silicone sealant was applied to, or introduced into, joints to which water was applied, 4 hours and 8 hours after application.

Figure 6:
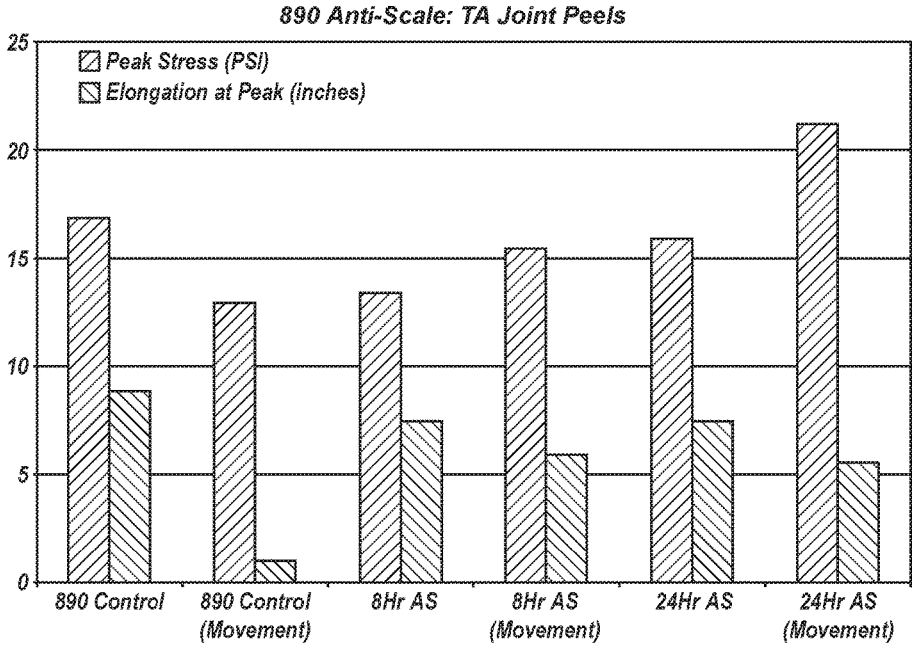

The graph of FIG. 6 shows the results of applying an anti-scaling agent (PENTRA SHIELD®) to a joint 8 hours and 24 hours before applying a DOW CORNING® 890 silicone sealant.

Figure 7:
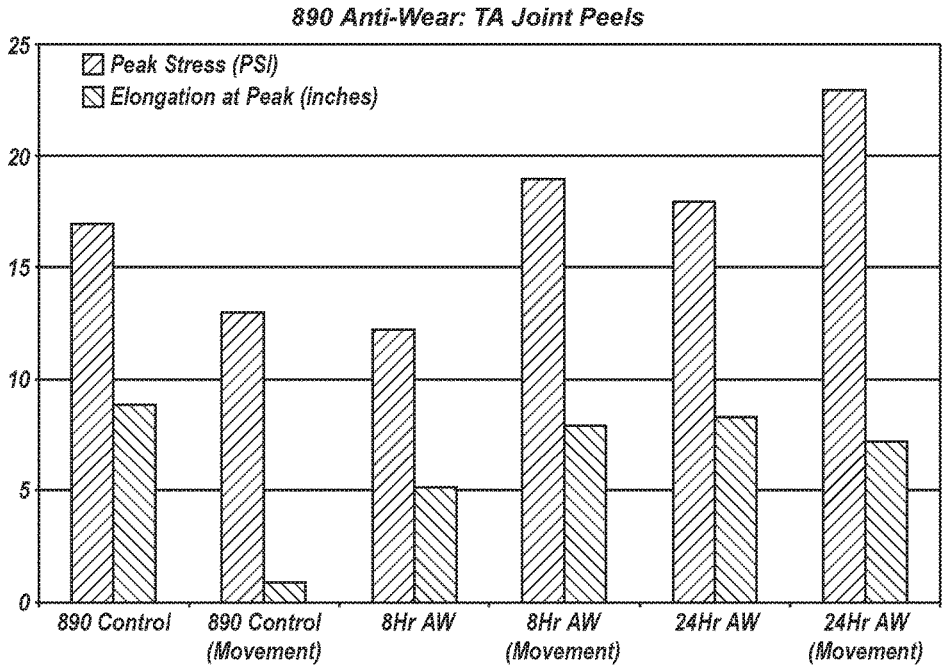

In the next graph, which appears as FIG. 7, the effects of pre-treatment with an anti-wear agent ("AW"—a lithium polysilicate hardener/densifier) on enabling DOW CORN- ING® 890 silicone sealant to adhere to a joint are illustrated, with the sealant being applied 8 hours and 24 hours after pre-treatment.

Figure 8:
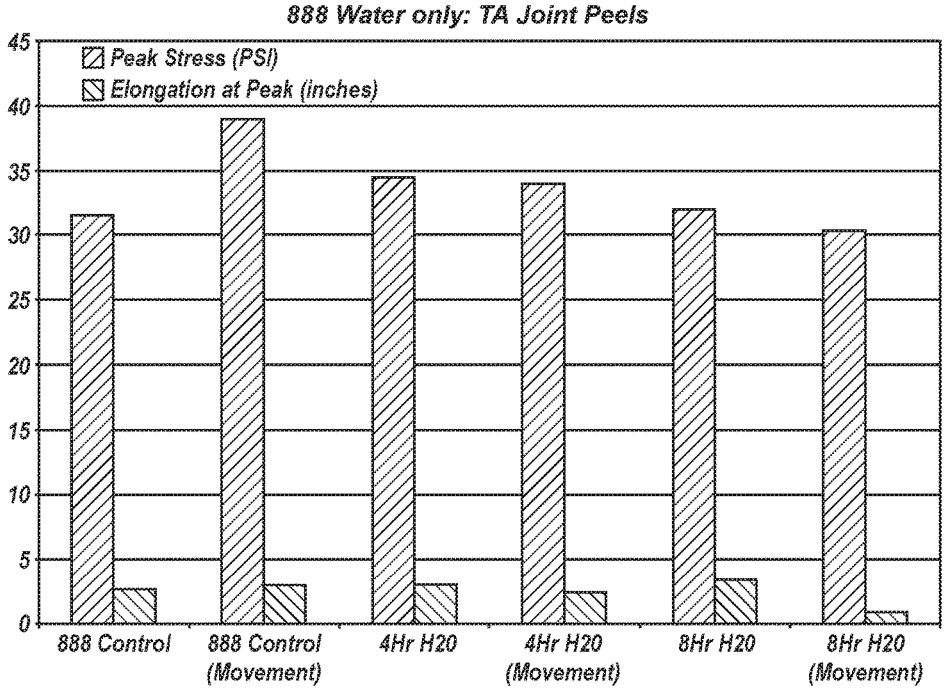
Figure 9:
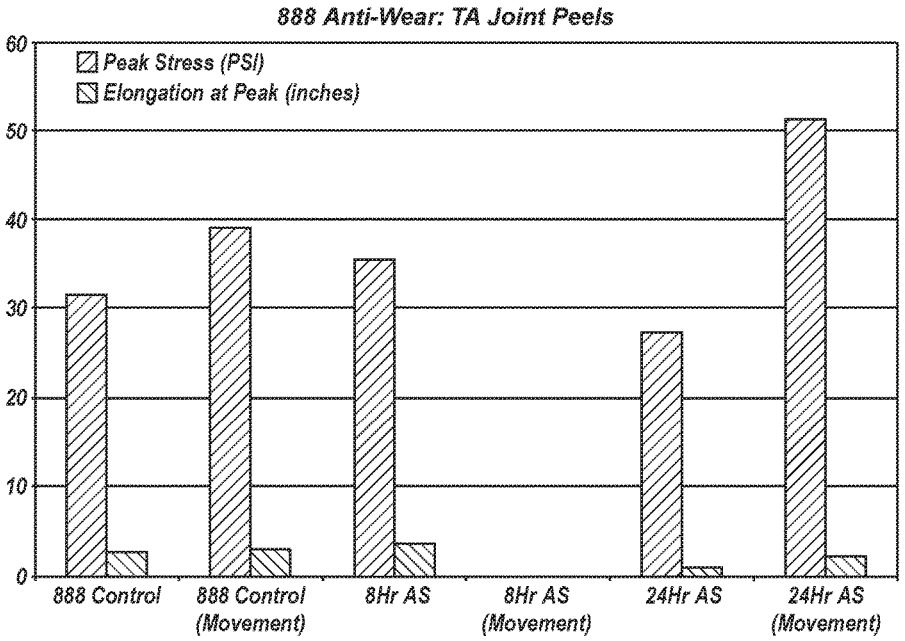
Figure 10:
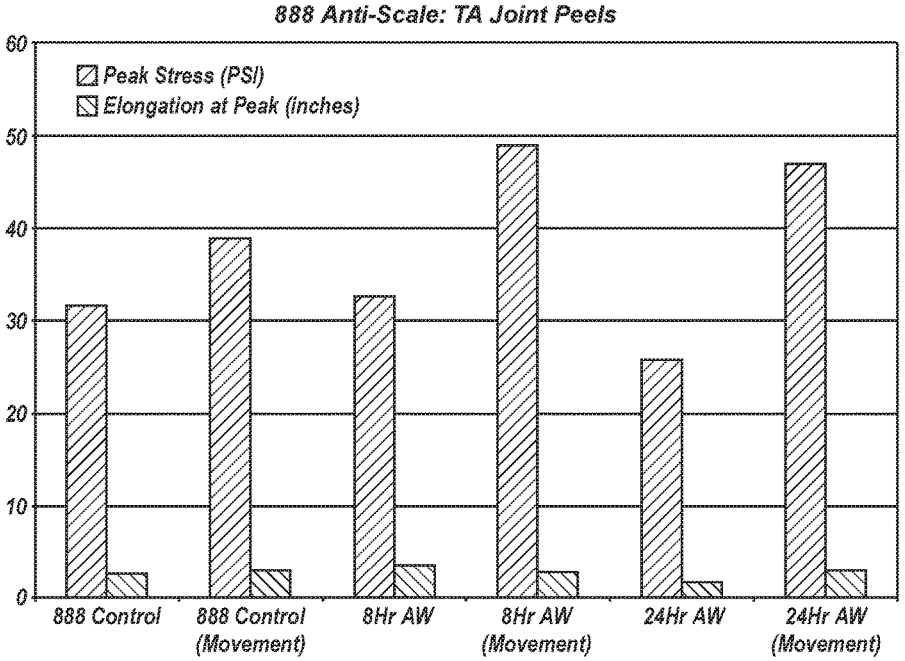

The three graphs of FIGS. 8-10 provide similar data for the abilities of pre-treatment with water, an anti-scaling agent and an anti-wear agent, respectively, to enhance adhesion of a sealant to pre-treated surfaces of a pavement joint.

The results of the sealant tests follow:

| 890 SEALANT | Peak Stress (PSI) | Elongation at Peak (inches) | Comments |
|---|---|---|---|
| CONTROL: | | | |
| 890 Control | 17 | 8.9 | 50% CF, on was 0 the other 100% |
| 890 Control (Movement) | 13 | 1 | 10% CF |
| 4 Hr $H_2O$ | 18.3 | 9.4 | 100% CF |
| 4 Hr $H_2O$ (Movement) | 18.2 | 8.5 | 0% CF |
| 8 Hr $H_2O$ | 14 | 6.5 | 0% CF |
| 8 Hr $H_2O$ (Movement) | 20.1 | 7 | 0% CF |
| ANTI-SCALE: | | | |
| 890 Control | 17 | 8.9 | 50% CF, on was 0 the other 100% |
| 890 Control (Movement) | 13 | 1 | 10% CF |
| 8 Hr AS | 13.5 | 7.5 | 0% CF |
| 8 Hr AS (Movement) | 15.6 | 6 | 0% CF |
| 24 Hr AS | 16 | 7.5 | 0% CF |
| 24 Hr AS (Movement) | 21.3 | 5.6 | 0% CF |
| ANTI-WEAR: | | | |
| 890 Control | 17 | 8.9 | 50% CF, on was 0 the other 100% |
| 890 Control (Movement) | 13 | 1 | 10% CF |
| 8 Hr AW | 12.3 | 5.2 | 0% CF |
| 8 Hr AW (Movement) | 19 | 8 | 0% CF |
| 24 Hr AW | 18 | 8.4 | 100% CF |
| 24 Hr AW (Movement) | 23 | 7.3 | 10% CF |

| 888 SEALANT | Peak Stress (PSI) | Elongation at Peak (inches) | Comments |
|---|---|---|---|
| CONTROL: | | | |
| 888 Control | 31.6 | 2.7 | 0% CF |
| 888 Control (Movement) | 39 | 3.1 | 0% CF |
| 4 Hr $H_2O$ | 34.5 | 3.2 | 0% CF |
| 4 Hr $H_2O$ (Movement) | 34 | 2.5 | 0% CF |
| 8 Hr $H_2O$ | 32 | 3.5 | 0% CF |
| 8 Hr $H_2O$ (Movement) | 30.3 | 1 | 0% CF |
| ANTI-SCALE: | | | |
| 888 Control | 31.6 | 2.7 | 0% CF |
| 888 Control (Movement) | 39 | 3.1 | 0% CF |
| 8 Hr AS | 35.5 | 3.5 | 0% CF |
| 8 Hr AS (Movement) | | | |
| 24 Hr AS | 27.4 | 1 | 0% CF |
| 24 Hr AS (Movement) | 51.3 | 2.2 | 0% CF |

-continued

| 888 SEALANT | Peak Stress (PSI) | Elongation at Peak (inches) | Comments |
|---|---|---|---|
| ANTI-WEAR: | | | |
| 888 Control | 31.6 | 2.7 | 0% CF |
| 888 Control (Movement) | 39 | 3.1 | 0% CF |
| 8 Hr AW | 32.6 | 3.6 | 0% CF |
| 8 Hr AW (Movement) | 49 | 2.8 | 0% CF |
| 24 Hr AW | 25.8 | 1.8 | 0% CF |
| 24 Hr AW (Movement) | 47 | 3 | 0% CF |

As these data indicate, pre-treatment of a joint may improve the ability of a sealant to adhere to the joint.

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

What is claimed:

1. A method for treating a joint in pavement, comprising:
applying a hardener/densifier to opposed surfaces of a joint in pavement defined between adjacent sections of the pavement; and
applying a coating to the opposed surfaces of the joint, the coating comprising:
an anti-scaling compound; and
a silane, a siloxane, and/or a silicone.

2. The method of claim 1, wherein applying the coating comprises applying a hydrophobic coating to the joint.

3. The method of claim 1, wherein applying the coating comprises applying the coating after applying the hardener/densifier.

4. The method of claim 1, wherein applying the coating comprises applying the coating while applying the hardener/densifier.

5. The method of claim 4, wherein applying the hardener/densifier and applying the coating comprise applying a compound including the hardener/densifier and the coating.

6. The method of claim 1, wherein applying the coating comprises applying a coating with the anti-scaling compound comprising a metal siliconate.

7. The method of claim 1, wherein applying the coating to the joint comprises applying an aqueous coating to the joint.

8. The method of claim 1, wherein applying the coating to the joint comprises applying an organic solvent-based coating to the joint.

9. The method of claim 1, further comprising:
cleaning the joint before applying the hardener/densifier to the joint.

10. The method of claim 1, wherein applying the hardener/densifier to the joint includes introducing the hardener/densifier into the joint.

11. The method of claim 1, wherein applying the coating to the joint comprises introducing the coating into the joint.

12. A pavement joint, comprising:
a first pavement element including a first pavement surface and a first end surface;
a second pavement element including a second pavement surface and a second end surface, the second pavement surface being substantially continuous with the first pavement surface of the first pavement element;

a joint defined by the first end surface of the first pavement element and the second end surface of the second pavement element, the first end surface and the second end surface comprising surfaces of the joint;

a reaction product of a hardener/densifier and concrete on the surfaces of the joint and portions of the first pavement surface and the second pavement surface located adjacent to the joint; and a coating on the surfaces of the joint, the coating comprising:

an anti-scaling compound; and a silane, a siloxane, and/or a silicone.

13. The pavement joint of claim 12, wherein the anti-scaling compound comprises a metal siliconate.

14. The pavement joint of claim 12, further comprising:

a seal between the first pavement element and the second pavement element.

15. The pavement joint of claim 14, wherein the seal comprises a silicone.

16. The pavement joint of claim 12, wherein the coating extends over portions of the first pavement surface and the second pavement surface located adjacent to the joint.

17. A composition, comprising:

a hardener/densifier; and a silane comprising silane solids dispersed throughout a solvent of the hardener/densifier.

18. The composition of claim 17, wherein the silane comprises about 40% or more of a weight of the composition.

19. The composition of claim 17, wherein the silane comprises a neat silane.

* * * * *